US009016801B2

(12) United States Patent
Li et al.

(10) Patent No.: US 9,016,801 B2
(45) Date of Patent: Apr. 28, 2015

(54) EARTH PRESSURE BALANCE SHIELD MACHINE WITHOUT CUTTER DISK

(75) Inventors: Jianbin Li, Zhengzhou (CN); Yulian He, Zhengzhou (CN)

(73) Assignee: China Railway Engineering Equipment Group Co., Ltd., Zhengzhou, Henan Province (CN)

( * ) Notice: Subject to any disclaimer, the term of this patent is extended or adjusted under 35 U.S.C. 154(b) by 0 days.

(21) Appl. No.: 14/387,128

(22) PCT Filed: May 3, 2012

(86) PCT No.: PCT/CN2012/075054

§ 371 (c)(1),
(2), (4) Date: Sep. 22, 2014

(87) PCT Pub. No.: WO2013/139069

PCT Pub. Date: Sep. 26, 2013

(65) Prior Publication Data

US 2015/0042146 A1 Feb. 12, 2015

(30) Foreign Application Priority Data

Mar. 23, 2012 (CN) ..... 2012 1 0079129

(51) Int. Cl.
*E21D 9/08* (2006.01)

(52) U.S. Cl.
CPC ..... *E21D 9/081* (2013.01)

(58) Field of Classification Search
USPC ..... 299/55, 56, 59; 405/141, 144
See application file for complete search history.

(56) References Cited

U.S. PATENT DOCUMENTS

2010/0164274 A1* 7/2010 Kondo et al. ..... 299/31

FOREIGN PATENT DOCUMENTS

| | | | |
|---|---|---|---|
| CN | 202510122 U | * | 10/2012 |
| JP | 03208990 A | * | 9/1991 |
| JP | 2005225306 A | * | 8/2005 |

* cited by examiner

*Primary Examiner* — Sunil Singh
(74) *Attorney, Agent, or Firm* — Novoclaims Patent Services LLC; Mei Lin Wong

(57) ABSTRACT

An EPB shield machine without disc cutter, which includes a partition unit formed by a moveable partition member (30) and a stationary partition member (31), a front shield unit (13) including a cutting unit (1) with cutting head (11) and cutting teeth (12), a shaft member (2) connected to the cutting head (11) and a power transmission unit formed by a transfer case (5), a reducer (6) and a driving motor (7). In the power transmission unit at an upper portion of the machine, the transfer case (5) is fixedly to the moveable partition member (30), a sliding arrangement supports the reducer (6) and the driving motor (7), which are connected to the transfer case (5, and a telescopic cylinder (26) is connected to the sliding arrangement. The machine has advantages of high cutting efficiency, balanced service life, high directional construability and high adaptability to tunnel cross section.

3 Claims, 4 Drawing Sheets

EARTH PRESSURE BALANCE SHIELD MACHINE WITHOUT CUTTER DISK

BACKGROUND OF THE PRESENT INVENTION

1. Field of Invention

The present invention relates to the technical field of shield machine, and more particularly to an earth pressure balance shield machine without disc cutter arrangement.

2. Description of Related Arts

At present, existing earth pressure balance shield machines in this country or aboard all utilize a disc cutter arrangement in their cutting system. In cylindrical shield machines, the disc cutter performs a circular movement; while in shield machines of rectangular, oval or other special shape, the disc cutter performs a planar movement through a crank linking arrangement, a swing arrangement or a profiling arrangement. Based on the geological condition and the engineering requirements, different types of cutting members such as hob, cutter or scraper are installed on the cutterhead. The cutting members move along with the cutterhead and no active rotation of the cutting members is allowed. Since the speed of action of the cutterhead is very low (a few rotation per minute), the linear velocity of cutting of the cutting members are then very low which limit the efficiency of cutting. Meanwhile, since the position of different cutting members on the cutterhead are varied, the linear velocity of cutting of different cutting members are varied greatly, therefore the operating life of different cutting members are varied greatly.

SUMMARY OF THE PRESENT INVENTION

In order to solve the problems in existing earth pressure balance shield machines which utilizes cutterhead and cutting members, the present invention provides an earth pressure balance shield machine without disc cutter arrangement. The shield machine does not include a disc cutter and each cutting member can rotate independently.

According to the present invention, the foregoing and other objects and advantages are attained by the followings:

The present invention provides an earth pressure balance shield machine without disc cutter arrangement which comprises a cutting unit, a shaft member, a spiral waste collecting member, an earth pressure balance cabin, a transfer case, a reducer, a driving motor, a waste conveyor, a partition unit for the earth pressure balance cabin, a sliding support, a telescopic cylinder, a propulsion cylinder, an airlock chamber, a front shield unit, a middle shield unit, a rear shield unit and a middle shield panel; the partition unit for the earth pressure balance cabin is formed by a moveable partition member and a stationary partition member, the front shield unit comprises a cutting unit at a front end of the front shield unit in which the cutting unit comprises a cutting head and a plurality of cutting teeth distributed on the cutting head, the shaft member having two distal ends securely connected to the cutting head and a power transmission unit respectively, the power transmission unit is formed by the transfer case, the reducer and the driving motor in which the transfer case is connected to the reducer and the driving motor; In the power transmission unit which is positioned at an upper portion of the earth pressure balance shield machine, a front end of the transfer case is fixedly connected to the moveable partition member of the partition unit for the earth pressure balance cabin while the reducer and the driving motor, which is connected to the transfer case, is supported through a sliding arrangement, and the telescopic cylinder is connected to a rear end of the sliding arrangement.

In the power transmission unit which is positioned at a lower portion of the earth pressure balance shield machine, a front end of the transfer case is fixedly connected to a middle shield support panel while the reducer and the driving motor, which is connected to the transfer case, is supported by a support frame, wherein the support frame has a bottom end fixedly connected to a rear end of the middle shield unit; the shaft member, which is connected to the power transmission unit at the lower portion of the of the earth pressure balance shield machine, is connected to the spiral waste collecting member, wherein an inlet of the waste conveyor is positioned at a rear end of the spiral waste collecting member, wherein a one-way valve is provided on the middle shield panel; wherein the cutting unit has a matrix arrangement in a projection of a vertical cross section of the front shield unit.

The moveable partition member is connected to the stationary partition member and the front shield unit by a plurality of screw connectors.

The sliding arrangement is formed by the sliding support, a sliding member and a guiding rail; the reducer and the driving motor are fixedly positioned on the sliding support, the sliding member is provided on a bottom end of the sliding support and is engaged with the guiding rail, the guiding rail is fixedly connected to a middle shield support frame, and a rear end of the sliding support is connected to the telescopic cylinder.

The present invention has the follow advantageous effect:

1. High Cutting Efficiency

The cutting efficiency of a cutting tool is closely related to the linear velocity of the cutting tool. For example, a cutter disc of a shield machine which has a diameter of 4 m will have a suitable rotational speed of 3 r/min, then the average linear velocity of the cutting member on the cutter disc will be 0.314 m/s. On the other hand, for the cutting member of the shield machine without disc cutter arrangement which is capable of independent and active rotation, the suitable rotational speed is 30 r/min, then the average linear velocity of the cutting member will be 1.256 m/s if the radius of gyration is 400 mm, that the average linear velocity is four times of the cutting tool of conventional design.

2. Balanced Working Life

For the shield machine with cutter disc, since the position of each cutting members on the cutter disc along its radial direction are different, the path of cutting of each cutting member driven by the cutter disc are different, therefore the rate of wearing of each cutting member are different. The cutting member along the outer peripheral of cutter disc will have a faster rate of wearing while the cutting member along the inner peripheral of cutter disc will have a slower rate of wearing. Accordingly, the replacement will be required more frequently and the operation efficiency is adversely affected.

For the shield machine without cutter disc arrangement, each individual cutting member is actively and independently rotated. The speed of rotation of all cutting members are the same and therefore the linear velocity of all cutting members are the same in general. Accordingly, the work life of each cutting member is approximately the same and mass replacement of cutting members are made possible, that dramatically save the time of replacement and increase the excavation efficiency of the shield machine.

3. Good Controllable Direction

For the shield machine with cutter disc, since the moment of inertia of the disc cutter is very great, the shield machine may be caused to rotate along the rotation direction of the disc cutter. In order to correct this rotation deviation, the disc cutter has to be reversed. Although this alternate forward and backward rotation action of the disc cutter can stabilize the excavation process in a forward direction, a certain level of difficulty for control is caused. Without a skillful control, a relative great level of deviation to the direction of excavation will be resulted.

In the shield machine of the present invention, the blades of spiral waste collecting member at different shaft member are arranged at an opposite direction such that the rotation direction of different shaft members are in opposite direction such that the moment of inertia of cutting members of different shaft members are balanced and therefore a rotation movement of the shield machine is avoided without requiring any additional corrective measures.

4. Strong Adaptability to Cross-Section of Tunnel Excavation Surface

For the shield machine with cutter disc, the most suitable excavation surface has a circular cross-section. For special cross-section condition such as rectangular, oval cross-section, complicated arrangement such as crank linking arrangement, swing arrangement or profiling arrangement are used to control the cutting path of the cutting tool. On the contrary, in the shield machine of the present invention which does not include any cutter disc arrangement and has a matrix arrangement for the cutting units, only changes in the matrix arrangement is required to fit different complicated shapes of cross-section of the excavation surface.

DETAILED DESCRIPTION OF THE PREFERRED EMBODIMENT

Embodiment 1

Figure 1:
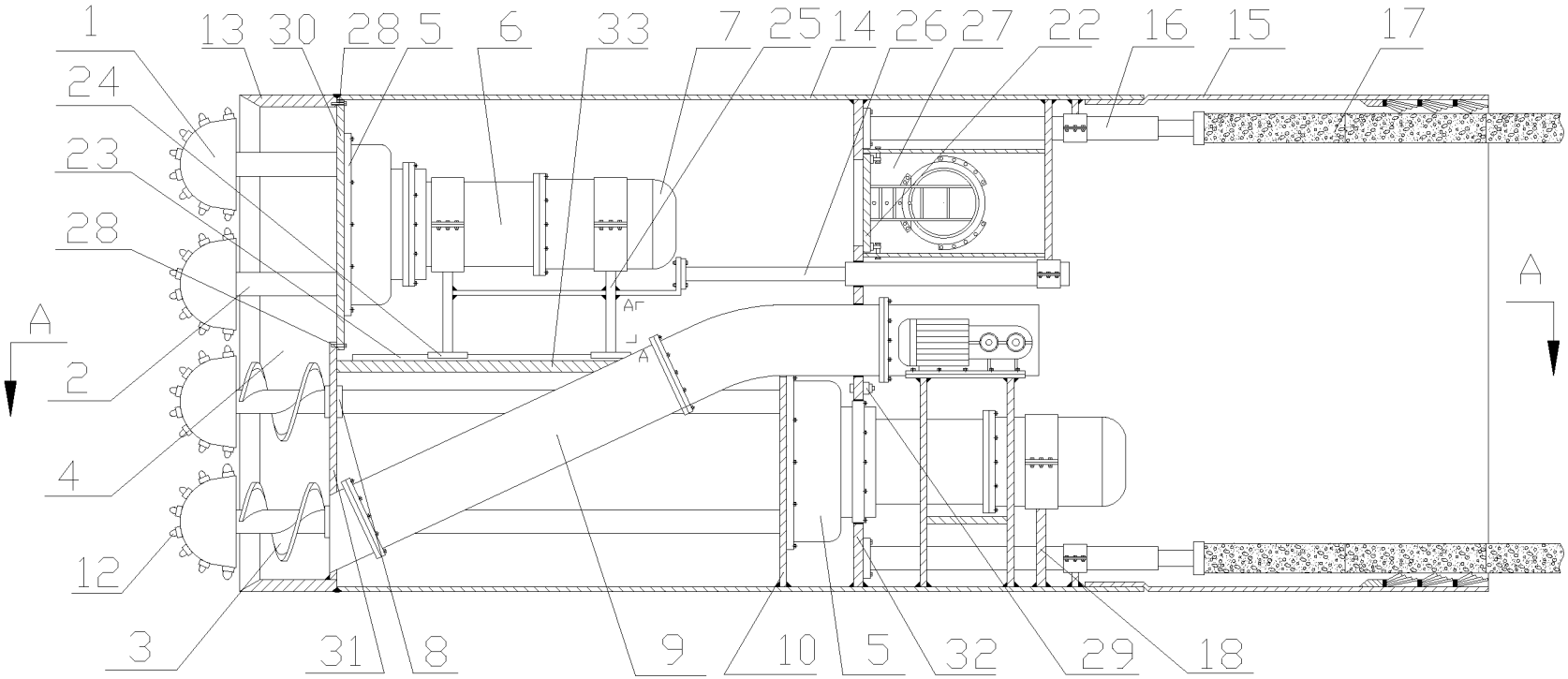
FIG. 1 is a structural illustration of an earth pressure balance shield machine according to the preferred embodiment of the present invention.
Figure 2:
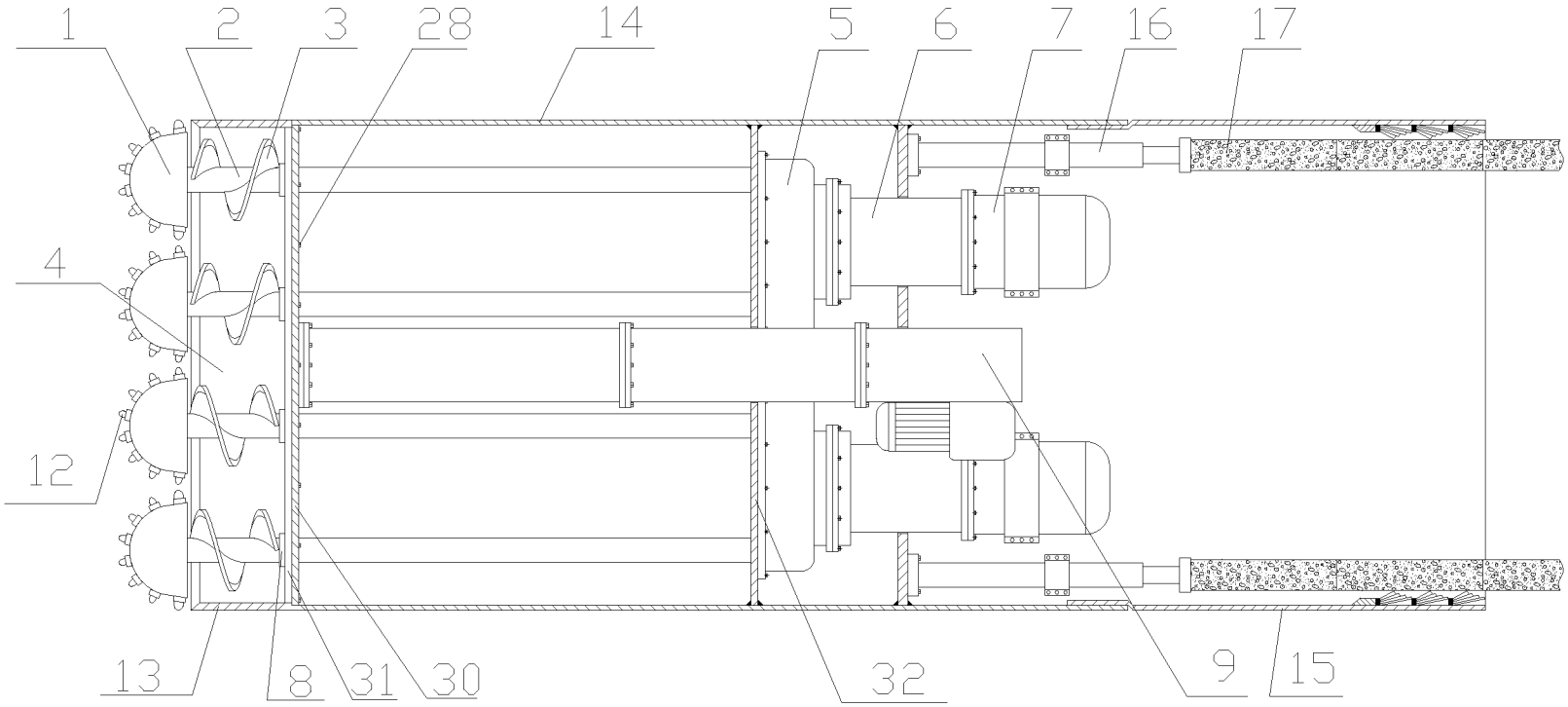
FIG. 2 is an A-A sectional view of FIG. 1.
Figure 3:
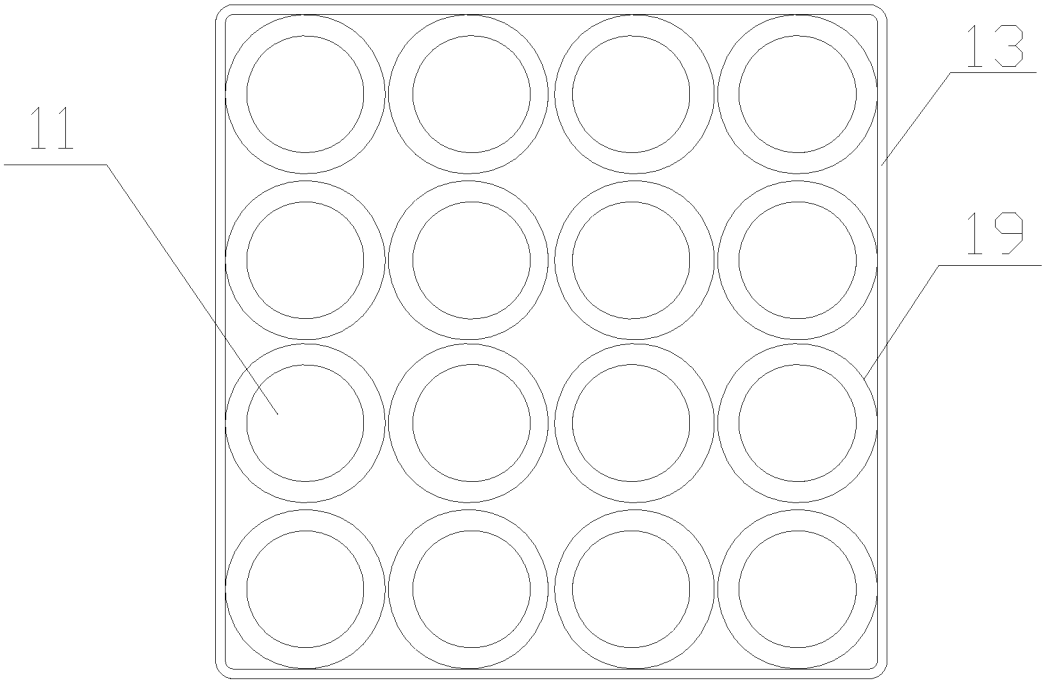
FIG. 3 is an illustration of a distribution of cutting units in a rectangular earth pressure balance shield machine according to the preferred embodiment of the present invention.

According to this preferred embodiment of the present invention, the earth pressure balance shield machine has a rectangular construction and no disc cutter arrangement is employed. The earth pressure balance shield machine according to this preferred embodiment of the present invention is arranged for tunnel excavation in which the tunnel has a rectangular cross-section, which is shown in FIG. 1 to FIG. 3 of the drawings.

According to the earth pressure balance shield machine of this preferred embodiment of the present invention, an electric motor is employed as a driving motor 7 and a flexible conveyor with scraper arrangement is employed as a waste conveyor 9.

According to this preferred embodiment of the present invention, the earth pressure balance shield machine comprises a cutting unit 1, a shaft member 2, a spiral waste collecting member 3, an earth pressure balance cabin 4, a transfer case 5, a reducer 6, a driving motor 7, a waste conveyor 9, a partition unit for the earth pressure balance cabin, a sliding support 25, a telescopic cylinder 26, a propulsion cylinder 16, an airlock chamber 27, a front shield unit 13, a middle shield unit 14, a rear shield unit 15 and a middle shield panel 32.

The front shield unit 13 comprises a cutting unit 1 at a front end of the front shield unit 13. The cutting unit 1 comprises a cutting head 11 and a plurality of cutting teeth 12 distributed on the cutting head 11. A shaft member 2 for the cutting head has two distal ends. Each cutting head 11 is fixedly connected to the first end of the shaft member 2 while the second end of the shaft member 2 is connected to a power transmission unit. The power transmission unit is formed by the transfer case 5, the reducer 6 and the driving motor 7 in which the transfer case 5 is connected to the reducer 6 and the driving motor 7. The power transmission unit positioned at an upper portion and the power transmission unit positioned at a lower portion of the earth pressure balance shield machine have different connection relationship with other parts or elements of the earth pressure balance shield machine. In the power transmission unit positioned at the upper portion, a front end of the transfer case 5 is fixedly connected to the moveable partition member 30 of the partition unit for the earth pressure balance cabin while the reducer 6 and the driving motor 7, which is connected to the transfer case 5, is supported through a sliding arrangement. The rear end of the sliding arrangement is connected to the telescopic cylinder 26. According to the earth pressure balance shield machine of this preferred embodiment of the present invention, the sliding arrangement comprises a sliding support 25, a sliding member 24 and a guiding rail 23. The reducer 6 and the driving motor 7 are fixedly positioned on the sliding support 25. The sliding support 25 has a bottom end connected to the sliding member 24 while the sliding member 26 is engaged with the guiding rail 23. The guiding rail 23 is fixed connected to a middle shield support frame 33. The sliding support 25 has a rear end connected to the telescopic cylinder 26. Alternately, a slot can be provided on the guiding rail while a sliding block which is complement to the slot of the guiding rail is provided through affixing to a bottom end of a supporting leg of the sliding support 25.

In the power transmission unit positioned at the lower portion, a front end of the transfer case 5 is fixedly connected to a middle shield support panel 10 while the reducer 6 and the driving motor 7, which is connected to the transfer case 5, is supported by a support frame 18. The support frame 18 has a bottom end fixedly connected to a rear end of the middle shield unit 14. The shaft member, which is connected to the power transmission unit positioned at the lower portion, is connected to the spiral waste collecting member 3. An inlet of the waste conveyor 9 is positioned at a rear end of the spiral waste collecting member 3. The earth pressure balance cabin 4 is formed by the front shield unit 13, the moveable partition member 30, a stationary partition member 31 and the excavation surface. In order to ensure the safety of workers during changing the cutting unit, a one-way valve 29 is provided on the middle shield panel 32. In order to reduce the fictional force during excavation process, the cutting teeth 12 form a spiral arrangement on the cutting head 11. In a projection of a vertical cross section of the front shield unit, the cutting unit 1 has a matrix arrangement (as shown in FIG. 3), wherein in FIG. 3, each of the circles in solid line refer to a front projection of the cutting head 11, each of the circles in phantom line 19 refer to a trajectory of the maximum cutting radius of the cutting teeth 12. As shown in FIG. 3, a cutting trajectory of the cutting unit 1 can basically cover the entire excavation surface of a tunnel.

In the power transmission unit, the transfer case 5 has a structural construction which is identical to the product of Luoyang Reastar Transmission Co. Limited. The transfer case 5 and the shaft member 2 can be connected by spline connector or flange connector or connector of other types.

The partition unit for the earth pressure balance cabin comprises the moveable partition member 30 and the stationary partition member 31. The moveable partition member 30 is connected to the stationary partition member 31 and the front shield unit 13 by screw connectors.

Embodiment 2

Figure 4:
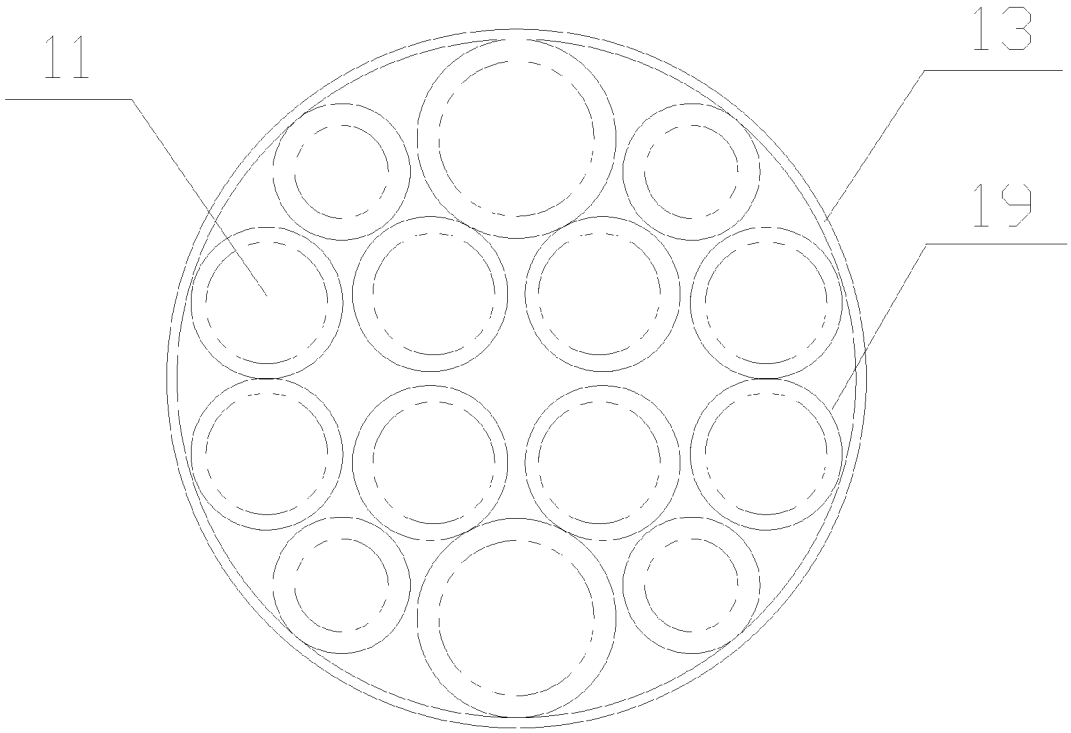
FIG. 4 is an illustration of a distribution of cutting units in a cylindrical earth pressure balance shield machine according to the preferred embodiment of the present invention.

According to this preferred embodiment of the present invention, the earth pressure balance shield machine has a cylindrical construction and no disc cutter arrangement is employed. The earth pressure balance shield machine according to this preferred embodiment of the present invention is arranged for tunnel excavation in which the tunnel has a circular cross-section. FIG. 4 refers to a left end view of the earth pressure balance shield machine of this embodiment.

According to the earth pressure balance shield machine of this preferred embodiment of the present invention, a hydraulic motor is employed as a driving motor 7 and a relay-style flexible screw conveyor is employed as a waste conveyor 9. All other structural construction and connection relationship between different parts are the same as that of embodiment 1.

In the embodiment 1, a hydraulic motor can also be used for the driving motor 7 and a relay-style flexible screw conveyor can also be used as a waste conveyor 9.

In the embodiment 2, an electric motor can also be used for the driving motor 7 and a flexible conveyor with scraper arrangement can also be used as a waste conveyor 9.

According to the above embodiments, the transfer case 5 has a four subdivision structure, that is, one transfer case 5 can drive rotational movement of four cutting units 1 at the same time. Of course, according to the design need, one driving motor can use to drive to rotate two cutting units, three cutting units, five cutting units or other number of cutting units simultaneously.

According to the earth pressure balance shield machine of the present invention, in additional to the rectangular construction in embodiment 1 and the cylindrical construction in embodiment 2, other special forms of construction such as polygonal or oval can be employed to facilitate tunnel excavation which has a different cross-section.

The number of cutting units can selectively adjusted according to the need of tunnel excavation with respect to the cross-section of the excavation surface.

According to the earth pressure balance shield machine without disc cutter arrangement, the cutting units do not require a disc cutter arrangement for support, all the cutting units are driven directly by the power transmission unit and thereby independent active rotation is realized.

During operation, a cutting action of the cutting unit 1 includes a rotational movement (the major action) and a longitudinal feed movement. The driving motor 7 drives the shaft member 2 and the cutting unit 1 to rotate through the reducer 6 and the transfer case 5. The transfer case 5 is arranged for using a smaller number of driving motor 7 to drive a larger number of cutting unit 1 to rotate at the same time for space saving purpose such that the bulky distribution of power transmission unit in the EPB shield machine is solved. As shown in FIG. 1 and FIG. 2 of the drawings, the longitudinal feed movement of the cutting unit 1 is realized by a reinforced concrete lining segment 17 and a propulsion cylinder 16. When the piston of the propulsion cylinder 16 is extended outward, the reinforced concrete lining segment 17 is pressed. Since the reinforced concrete lining segment 17 is affixed securely to the wall of the tunnel through slurry solidification, its support reaction is sufficient on the propulsion cylinder 16 to drive the entire shield machine (which includes the front shield unit 13, the middle shield unit 14 and the rear shield unit 15) to propel in a forward direction while at the same time driving the longitudinal feed movement of the cutting unit 1.

During the tunnel excavation process, the waste which falls into a bottom of the earth pressure balance cabin 4 is continuously moved backward to the inlet of the waste conveyor 9 to facilitate removal through the spiral waste collecting member 3 which is installed on the shaft member 2 in the power transmission unit at the lower portion.

During the tunnel excavation process, the cutting unit should be replaced when the cutting unit wears excessively. When replacing the cutting unit, the waste in the earth pressure balance cabin 4 is emptied first. Then the screw connectors are loosened such that the moveable partition member 30 is disconnected to the stationary partition member 31 and said front shield unit 13. The sliding support 25, the power transmission unit at the upper portion and the cutting unit 1 are moved backward along the guiding rail for a predetermined distance through a retraction of the telescopic cylinder 26, then a worker can enter the earth pressure balance cabin through a gap between the moveable partition member 30 and the stationary partition member 31 to replace the cutting unit.

In order to ensure the safety of the worker, based on the geological conditions of the excavation surface, 0~3 bar compressed air is injected into the enclosed space at a front end of the middle shield panel 32 through a one-way valve 29 in order to balance the earth and water pressure of the excavation surface and prevent tunnel collapse.

In order to prevent pressure-related diseases of the worker, direct movement between high pressure condition and atmospheric condition is not allowed and a transition through the airlock chamber 27 is required. After the worker enters the airlock chamber 27, the pressure inside the airlock chamber is increased by injecting compressed air. The gate 22 can only be open when the pressure is increased to the level which is the same as that of the location at a front end of the middle shield panel 32 so that safety entrance to the location at the front end of the middle shield panel 32 is ensured. When the worker is retreated from the location at the front end of the middle shield panel 32 into the airlock chamber 27, the worker can only retreat from the airlock chamber 27 after the pressure inside the airlock chamber 27 is decreased to atmospheric pressure.

For maintenance and replacement convenience, most of the parts are connected by using screw connectors. For example, the driving motor 7, the reducer 6 and the transfer case 5 at the upper portion of the shield machine are connected by screw connectors respectively, the front end of the transfer case 5 is affixed onto the moveable partition member 30 by screw connectors, the moveable partition member 30 is connected to the stationary partition member 31 and the front shield unit 13 by screw connectors, the reducer 6 and the driving motor 7 are connected to the sliding support 25 by screw connectors, and the rear end of the sliding support 25 is connected to the telescopic cylinder 26 by screw connectors.

What is claimed is:

1. An earth pressure balance shield machine without disc cutter arrangement which comprises a cutting unit (1), a shaft member (2), a spiral waste collecting member (3), an earth pressure balance cabin (4), a transfer case (5), a reducer (6), a driving motor (7), a waste conveyor (9), a partition unit for the earth pressure balance cabin, a sliding support (25), a telescopic cylinder (26), a propulsion cylinder (16), an airlock chamber (27), a front shield unit (13), a middle shield unit (14), a rear shield unit (15) and a middle shield panel (32), characterized in that, said partition unit for the earth pressure balance cabin comprises a moveable partition member (30)

and a stationary partition member (31), said front shield unit (13) comprises a cutting unit (1) at a front end of said front shield unit (13) in which said cutting unit (1) comprises a cutting head (11) and a plurality of cutting teeth (12) distributed on said cutting head (11), a shaft member (2) for said cutting head having two distal ends securely connected to said cutting head (11) and a power transmission unit respectively, said power transmission unit is formed by said transfer case (5), said reducer (6) and said driving motor (7) in which said transfer case (5) is connected to said reducer (6) and said driving motor (7), wherein in said power transmission unit which is positioned at an upper portion of said earth pressure balance shield machine, a front end of said transfer case (5) is fixedly connected to said moveable partition member (30) of said partition unit for the earth pressure balance cabin while said reducer (6) and said driving motor (7), which is connected to said transfer case (5), is supported through a sliding arrangement, said telescopic cylinder (26) is connected to a rear end of said sliding arrangement;

wherein in said power transmission unit which is positioned at a lower portion of said earth pressure balance shield machine, a front end of said transfer case (5) is fixedly connected to a middle shield support panel (10) while said reducer (6) and said driving motor (7), which is connected to said transfer case (5), is supported by a support frame (18), wherein said support frame 18 has a bottom end fixedly connected to a rear end of said middle shield unit (14); wherein said shaft member, which is connected to said power transmission unit at said lower portion of said of said earth pressure balance shield machine, is connected to said spiral waste collecting member (3), wherein an inlet of said waste conveyor (9) is positioned at a rear end of said spiral waste collecting member (3), wherein a one-way valve (29) is provided on said middle shield panel (32); wherein said cutting unit (1) has a matrix arrangement in a projection of a vertical cross section of said front shield unit.

2. The earth pressure balance shield machine without disc cutter arrangement according to claim 1, characterized in that, said moveable partition member (30) is connected to said stationary partition member (31) and said front shield unit (13) by a plurality of screw connectors.

3. The earth pressure balance shield machine without disc cutter arrangement according to claim 1, characterized in that, said sliding arrangement is formed by said sliding support (25), a sliding member (24) and a guiding rail (23); said reducer (6) and said driving motor (7) are fixedly positioned on said sliding support (25), said sliding member (24) is provided on a bottom end of said sliding support (25) and is engaged with said guiding rail (23), said guiding rail (23) is fixedly connected to a middle shield support frame (33), and a rear end of said sliding support (25) is connected to said telescopic cylinder (26).

* * * * *